US007358631B2

(12) United States Patent
Morishitahara

(10) Patent No.: US 7,358,631 B2
(45) Date of Patent: Apr. 15, 2008

(54) BLOWER DEVICE

(75) Inventor: Yoshiharu Morishitahara, Tottori-ken (JP)

(73) Assignee: Nidec Corporation, Kyoto (JP)

( * ) Notice: Subject to any disclaimer, the term of this patent is extended or adjusted under 35 U.S.C. 154(b) by 401 days.

(21) Appl. No.: 10/906,933

(22) Filed: Mar. 14, 2005

(65) Prior Publication Data

US 2005/0202713 A1 Sep. 15, 2005

(30) Foreign Application Priority Data

Mar. 12, 2004 (JP) ..... 2004-070127

(51) Int. Cl.
*H02K 11/00* (2006.01)

(52) U.S. Cl. ..... 310/71

(58) Field of Classification Search ..... 310/71, 310/89; 417/423.14
See application file for complete search history.

(56) References Cited

U.S. PATENT DOCUMENTS 5,189,327 A * 2/1993 Ootsuka et al. ..... 310/71
6,174,145 B1 * 1/2001 Taniguchi ..... 417/423.14
6,511,303 B2 * 1/2003 Obara ..... 417/423.12
6,554,230 B1 * 4/2003 Horski ..... 248/49
6,942,471 B2 * 9/2005 Weisser ..... 417/423.1
7,066,720 B2 * 6/2006 Cheng et al. ..... 417/423.3

FOREIGN PATENT DOCUMENTS

JP U-S62-178770 11/1987
JP U-H03-101155 10/1991
JP A-H04-111965 4/1992
JP U-3091634 11/2002

* cited by examiner

*Primary Examiner*—Dang Le
*Assistant Examiner*—Nguyen N Hanh
(74) *Attorney, Agent, or Firm*—Westerman, Hattori, Daniels & Adrian, LLP.

(57) ABSTRACT

A blower device of the present invention includes an electric motor having an impeller, a housing for accommodating the electric motor having the impeller therein, and a bind member which fixes, to the housing, lead wires which are led out from the motor and which supply current or a control signal. The bind member fixes the lead wires to the housing in any of the following methods: a method in which the bind member is wound around the lead wires and a portion of the housing together, and a method in which both ends of the bind member which is wound around the lead wires are inserted through a through hole formed in the housing. The bound bind member is accommodated in a groove portion formed in the housing.

14 Claims, 8 Drawing Sheets

BLOWER DEVICE

BACKGROUND OF THE INVENTION

1. Field of the Invention

The present invention relates to a lead wire fixing structure for fixing a lead wire led out from an electric motor in a blower device which is driven by the electric motor used for various equipment such as O.A. equipment, home electrical equipment, equipment mounted on a vehicle and the like.

2. Description of Related Art

A blower device is widely used for cooling or ventilating various equipment such as O.A. equipment, home electrical equipment, equipment mounted on a vehicle and the like. A general blower device includes an electric motor having an impeller, a housing which supports the motor therein and through which air induced by the impeller flows, and a plurality of lead wires led out from the housing for supplying current from an external power supply to the motor and for sending and receiving a control signal between the motor and an external control unit. There are a axial flow blower device, a centrifugal blower device, a cross-flow blower device each having different air blowing characteristics, and their impellers and housings have different shapes. One ends of the lead wires are connected to a circuit board provided in the electric motor, and electrically connected to a stator of the motor through the circuit board. The other ends of the lead wires are led out from the housing such that the other ends can electrically be connected to the external power supply or the like provided independently from the motor. The lead wires are fixed to the housing so that the lead wires do not come into contact with the impeller or a rotor of the motor or the lead wires do not function as resistance against the air flow on their way to the outside of the housing from the circuit board. Here, the lead wire comprises a wire member through which current can pass and which is coated with insulating material.

There is a known conventional fixing structure of lead wires described in Japanese Utility Model Application Laid-open No. 62-178770. According to this fixing structure, a flange of the housing is notched to form a support groove, and lead wires are retained in the groove. When it is required to reliably fix the lead wires to the housing, there is a known lead wire fixing structure using a binding band as shown in Japanese Utility Model Registration No. 3091634. According to this lead wire fixing structure, the binding band is wound around the lead wires at one end of a through hole of the housing, and both ends of the binding band are inserted into the through hole, and the binding band is bound at the other end of the through hole. The binding band is strongly bound, the bound portion does not come out from the through hole and thus, the lead wires can reliably be fixed to the housing.

The conventional lead wire fixing structure has a merit that the lead wires can reliably be fixed to the housing, but since the lead wires and the binding band protrude from the outermost surface of the housing, this conventional fixing structure is not suitable if installation space is limited when the blower device is mounted on a predetermined portion of the prescribed equipment. There is an adverse possibility that the portion protruding from the housing of the lead wire fixing structure comes into contact with an external object and lead wire failure is generated, and the conventional fixing structure is not suitable when high reliability is required.

BRIEF SUMMARY OF THE INVENTION

It is an object of the present invention to provide a blower device which can be used even an installation space of the blower device is limited, and which can reliably fix lead wires to a housing.

A lead wire fixing structure of the blower device of the present invention is characterized in that current or control signal supplying lead wires led out from an electric motor having an impeller are fixed to a portion of a housing which accommodates the motor by means of a bind member.

The lead wire fixing structure comprises the following two elements. The first element is that the bind member fixes the lead wires to the housing in any of the following methods: a method in which the bind member is wound around the lead wires and a portion of the housing and binds them together, and a method in which both ends of the bind member which is wound around the lead wires are inserted through a through hole formed in the housing. The second element is that the lead wires and the bind member are accommodated in an accommodating portion of the housing and they do not protrude from outermost surfaces of the housing, except for a place where the lead wires are led out from the housing to an external power supply or the like.

The outermost surfaces of the housing are defined as portions and surfaces of the housing which are virtually formed in outermost location of the housing and which may be in contact with an external object when the blower device is mounted on a predetermined portion of an equipment, and in this case the outermost surfaces may include a front surface and a back surface of the housing which are confronting in the rotation axis direction, and radially outermost peripheral surfaces of the housing. With this structure, since the lead wires are strongly fixed to the housing, the blower device is extremely reliable. In addition, since the lead wire fixing portion is accommodated in the accommodating portion of the housing and do not protrude outside from the outermost surfaces of the housing, except for a place where the lead wires are led out from the housing to an external power supply or the like, as a result the lead wires do not become obstruction when the blower device is mounted on an actual device. As a result, the blower device can be used even when the installation space thereof is limited. Since the lead wire fixing portion does not come into contact with the external object, the inconvenience of the lead wires can be avoided.

The blower device of the present invention can be applied to an axial flow blower device and a centrifugal blower device.

DETAILED DESCRIPTION OF THE INVENTION

A first embodiment of a blower device of the present invention will be explained with reference to FIGS. 1 to 3 based on an axial flow blower device.

Figure 1:
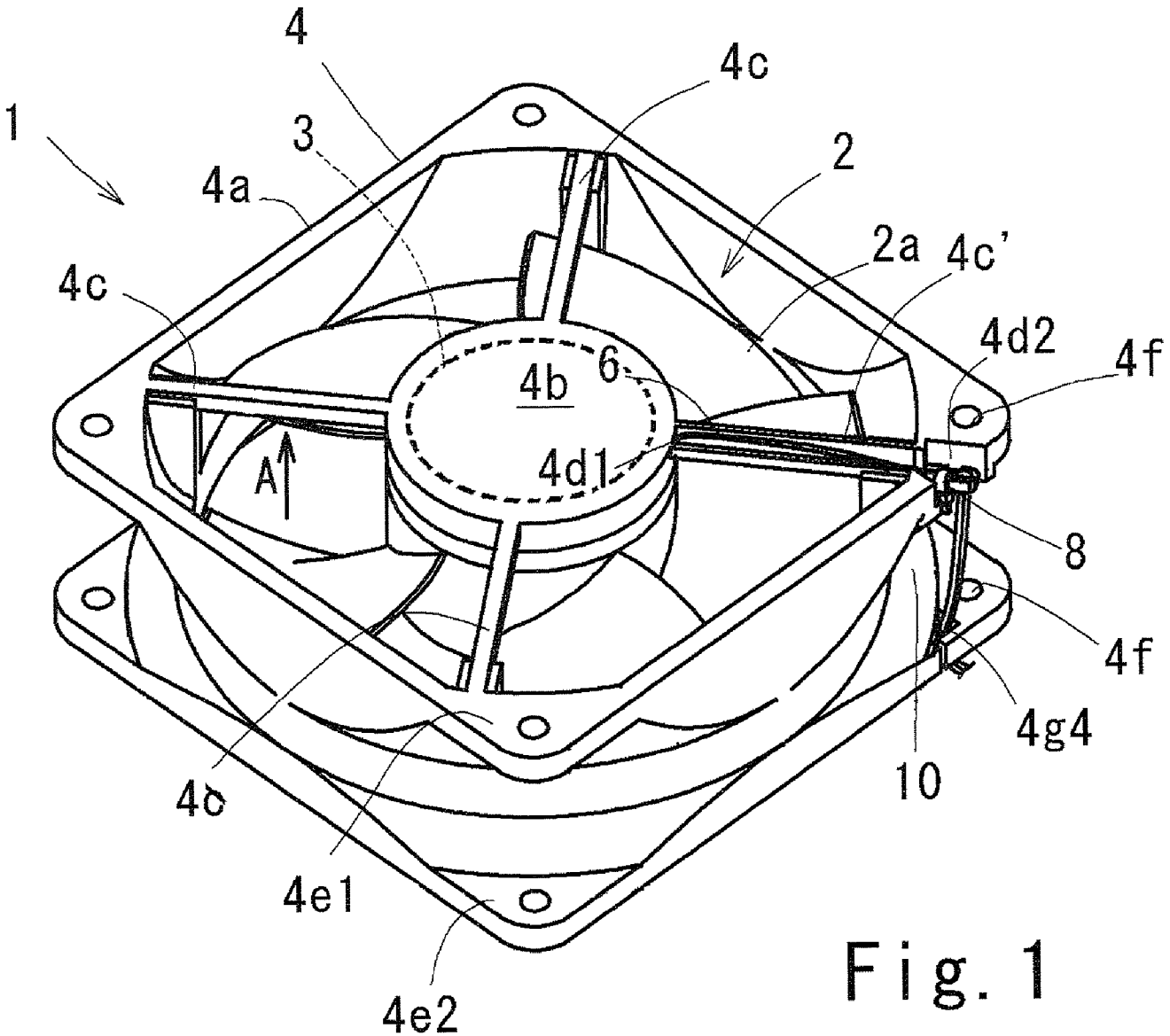
FIG. 1 is a perspective view of a blower device according to a first embodiment of the present invention.

The blower device 1 shown in FIG. 1 includes an electric motor 2 having an impeller 2*a*, and a housing 4 surrounding the impeller 2*a*. The motor 2 includes a stator having a core around which a coil is wound, a rotor which is opposed to the state and rotates around a rotation axis and which includes the impeller 2*a*, electronic components such as a sensor for detecting a rotation state of the rotor, and a circuit board 3 having the electronic components and lead wires which supply current from an external power supply to the stator and which sends and receives a control signal to and from the external control unit. The circuit board may be changed for a flexible printed circuit. The electric motor 2 is supported by a plurality of arms 4*c* and 4*c*' extending from an inner peripheral wall of the front surface side of the housing 4 to a central portion of the housing 4. The plurality of lead wires 6 connected to the circuit board 3 are led outside of the housing 4 through a predetermined arm 4*c*'. The lead wires 6 are fixed to the housing 4 using a later-described binding band 8. If the electric motor 2 rotates, air flow is generated by the impeller 2*a*, and the air flows along a rotation axis direction of the motor 2, and flows from a back surface side opening (suction port) in the housing 4 toward a front surface side opening (discharge port). Such a blower device is called an axial flow fan. Here, the number of lead wires 6 is two in this embodiment, when the number is three or more, the lead wires are led out as one wire by means of a rubber tube in some cases. The housing 4 is provided at its outer periphery with a housing outer frame 4*a*. A housing front surface and a housing back surface respectively located on front and back sides in the rotation axis direction of the motor, and a housing-side peripheral surface located radially outer side are imaginarily defined by this housing outer frame 4*a*. These surfaces constitute outermost surfaces of the blower device. The terms "front surface side" and "back surface side" of the housing and the like are used in this specification. These terms are used for making the explanation more clearly, and the terms do not limit the embodiment and the scope of right.

A motor support portion 4*b* supports the motor 2. The motor support portion 4*b* is supported by four arms 4*c* and 4*c* on a front surface side inner peripheral wall of the cylindrical housing outer frame 4*a* which surrounds an outer periphery of the impeller 2*a*. Of the four arms, the arm 4*c*' which constitutes a guide portion is formed at its front surface side with a first guide groove 4*d*1 for accommodating the lead wires 6 therein. The first guide groove 4*d*1 is in communication with a second guide groove 4*d*2 (corresponding to an accommodating portion) provided in a flange 4*e*1 of an outer peripheral wall of the front surface side of the housing outer frame 4*a*. The lead wires 6 are led out from the housing 4 through first and second guide grooves 4*d*1 and 4*d*2 from the side of the circuit board 3. The housing outer frame 4*a* is provided at its outer peripheral wall of back surface side with a back surface side flange 4*e*2 having the same shape as that of the flange 4*e*1 of the front surface side described above. Both the flanges 4*e*1 and 4*e*2 are provided in four corners of the outer peripheral wall of the back surface side and front surface side of the housing outer frame 4*a* The flanges 4*e*1 and 4*e*2 are confronting in rotation axis direction respectively. Each of the flanges 4*e*1 and 4*e*2 is provided with a through hole 4*f* which penetrates the flange in the thickness direction. The through hole 4*f* is used as a screw hole for mounting the blower device 1 on a predetermined portion if necessary.

Figures 2A, 2B:
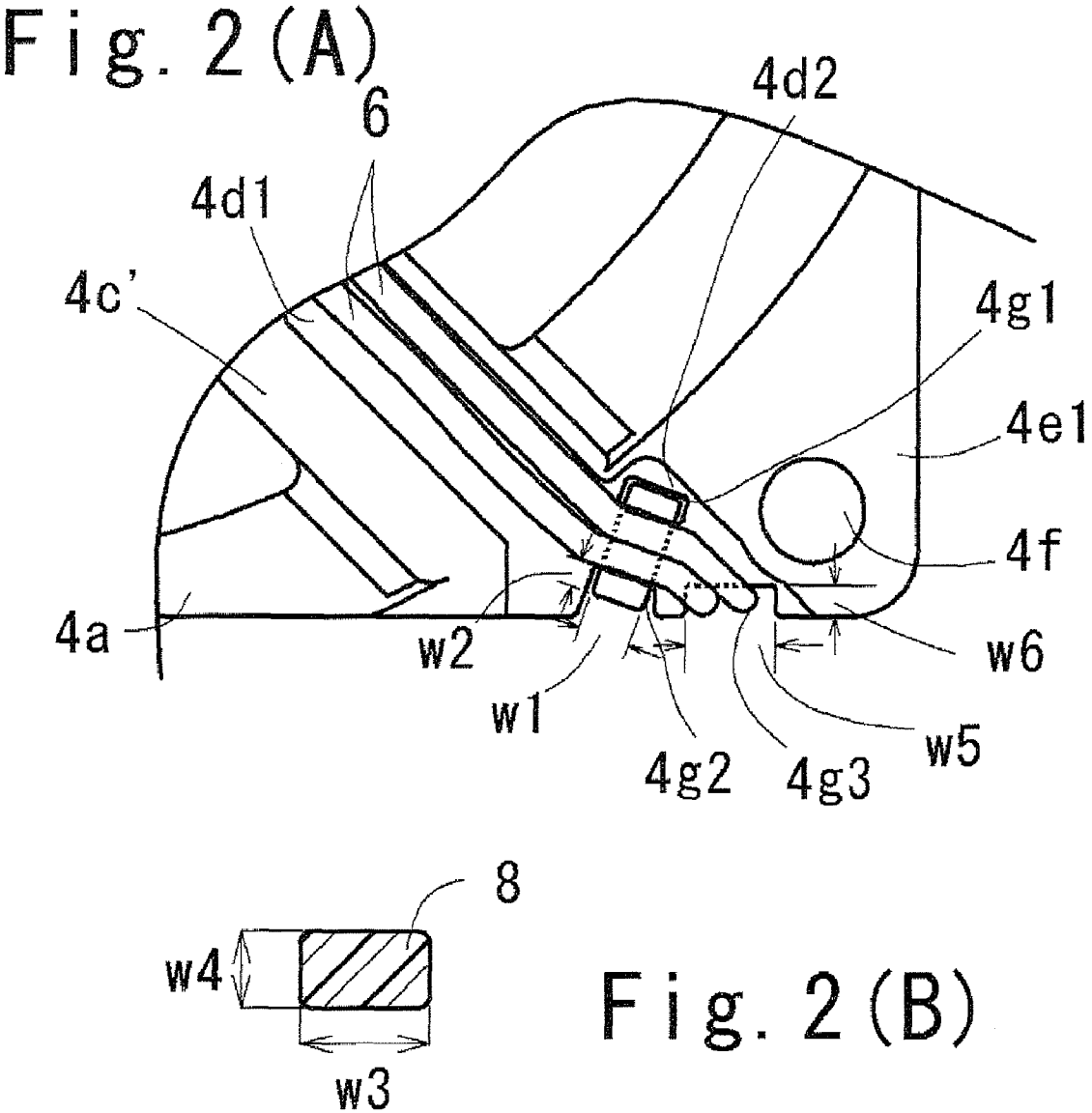
FIG. 2 are enlarged views of essential portions of the blower device shown in FIG. 1.
Figure 3:
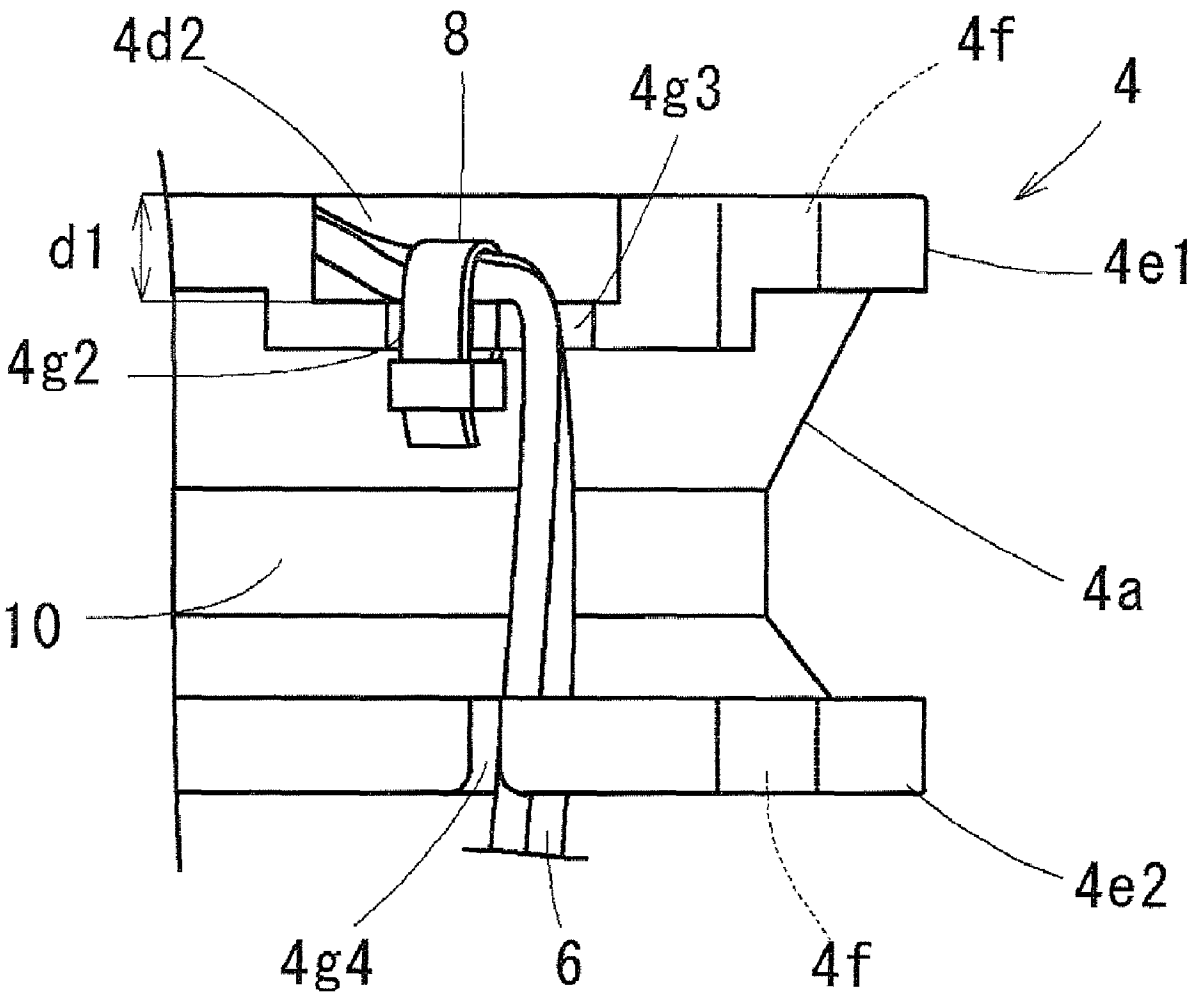
FIG. 3 is an enlarged view of another essential portion shown in FIG. 1.

As shown in FIGS. 2*a* and 3, the surface of the second guide groove 4*d*2 on the front surface side of the flange 4*e*1 is dented by thickness d1 which is about half of the flange 4*e*1, and the second guide groove 4*d*2 is in communication with the first guide groove 4*d*1 and the side peripheral surface of the flange 4*e*1. The second guide groove 4*d*1 is formed with a rectangular lead wire fixing hole 4*g*1 which passes through the flange 4*e*1 on the front surface side, a first notch 4*g*2 which is formed at location opposed to the lead wire fixing hole 4*g*1 by notching inwardly from the side peripheral surface of the flange 4*e*1, and a second notch 4*g*3 formed at location adjacent to the first notch 4*g*2 by notching from the side peripheral surface. The back surface side flange 4*e*2 opposed to the second notch 4*g*3 is formed with a third notch 4*g*4 notched from the side peripheral surface. A radially outside opening width of the third notch 4*g*3 is smaller than a line diameter of the lead wire 8, and the inside of the third notch 4*g*3 is a gap of such a size that the plurality of lead wires 8 can be accommodated.

As shown in FIGS. 2*a* and 3, the lead wires 6 guided from the first guide groove 4*d*1 pass between the lead wire fixing hole 4*g*1 of the second guide groove 4*d*2 and the first notch 4*g*2, and are led into the back surface side of the back surface side flange 4*e*2 from the third notch 4*g*4 through the second notch 4*g*3.

The lead wires 6 located in the second guide groove 4*d*2 are fixed to the housing 4 by the binding band 8. The INSULOK® tie produced by Tyton Company of Japan Limited is known as the binding band 8 for example. The binding band 8 is a flexible band-like bind member integrally formed of synthetic resin such as nylon®. The binding band 8 is provided at its one end with a connecting portion. The connecting portion has an insertion hole through which the other end of the binding band 8 is inserted. If the other end of the binding band 8 is inserted into the insertion hole, the other end is prevented from being pulled out by frictional resistance between the surface of the other end and the inner peripheral surface of the insertion hole, and both ends can strongly be bound.

The binding band 8 covers the lead wires 6 which are pulled in a pulling-out direction in such a degree that the lead wires 6 do not protrude from the first guide groove 4*d*1. The one end of the binding band 8 is led out toward the back surface side of the front surface side flange 4*e*1 through the first notch 4*g*2, the other end of the binding band 8 is inserted into the lead wire fixing hole 4*g*1 and is led out toward the back surface side of the flange 4*e*1. The binding band 8 which was pulled out toward the back surface side of the front surface side flange 4*e*1 is bound on the back surface side of the flange 4*e*1, and the binding band 8 can collectively bind the lead wires 6 and the flange 4*e*1. That is, the bound portion of the binding band 8 is formed on the back surface side of the front surface side flange 4*e*1. Since the binding band 8 is bound such that its both ends are bound and its annular shape becomes as small as possible, the lead wires 6 comes into tight contact with the binding band 8 together with the front surface side flange 4*e*1. The plurality of lead wires 6 become substantially immovable with respect to the binding band 8 and the flange 4*e*1 and fixed by great frictional resistance with respect to the front surface side flange 4*e*1.

That is, one ends of the plurality of lead wires 6 accommodated in the first guide groove 4*d*1 are connected to the circuit board 3 and the other ends are fixed to the second guide groove 4*d*2 of the front surface side flange 4*e*1 by the binding band 8. Thus, the lead wires 6 do not float up from the first guide groove 4*d*1, do not deviate in the lateral direction, do not move in the pulling-out direction of the lead wires 6 almost at all, and the lead wires 6 are strongly fixed. This embodiment is based on a case in which the back surface side of the back surface side flange 4*e*2 has not limitation in terms of installation space. Thus, the lead wires 6 are pulled out in this direction.

The lead wires 6 fixed by the binding band 8 are bent toward the back surface side flange 4*e*2 in the second notch 4*g*3, and retained by the third notch 4*g*4, and pulled out of the housing 4 from the back surface of the back surface side flange 4*e*2.

As shown in FIGS. 2*a* and 2*b*, an opening width w1 of the first notch 4*g*2 is greater than a lateral width w3 of the binding band 8, and an inner width w2 of the first notch 4*g*2 is greater than a thickness w4 of the binding band 8. Thus, the binding band 8 does not protrude from the side peripheral surface of the front surface side flange 4*e*1. A thickness d1 of the second guide groove 4*d*2 is set greater than a sum of a line diameter ϕ of the lead wires 6 and a thickness w4 of the binding band 8. Thus, the binding band 8 does not protrude from the surface of the front surface side flange 4*e*1. The bound portion of the binding band 8 is located in a recess 10 formed by the back surface side of the front surface side flange 4*e*1, the surface of the back surface side flange 4*e*2 and an outer peripheral surface of the housing outer frame 4*a* and thus, the binding band 8 does not protrude from the side peripheral surfaces of the flanges 4*e*1 and 4*e*2. An opening width w5 of the second notch 4*g*3 is greater than a total of the line diameters ϕ of the plurality of lead wires 6, and an inner width w6 of the second notch 4*g*3 is greater than the line diameter ϕ of the lead wire 6 and thus, the plurality of lead wires 6 do not protrude from an outer side surface of the first guide groove 4*d*1. The plurality of lead wires 6 passing through the recess 10 are retained in the third notch 4*g*4, the lead wires 6 do not protrude from the side peripheral surfaces of the flanges 4*e*1 and 4*e*2.

With the above structure, the plurality of lead wires 6 are strongly fixed such that the lead wires 6 are substantially immovable in any directions by the binding band 8. Thus, the lead wires 6 do not move and float from the first guide groove 4*d*1 or second guide groove 4*d*2, and do not come into contact with the impeller 2*a* or prescribed portions adjacent to the front surface side opening of the housing 4. Even if the lead wires 6 are excessively pulled, the tensile strength does not reach the connecting portion between the lead wires 6 and the circuit board 3 and thus, the lead wires 6 are not easily broken at the connecting portion. The plurality of lead wires 6 and the binding band 8 are fixed without protruding from the front surface and the side peripheral surface of the front surface side flange 4*e*1, i.e., from the outermost surfaces of the housing 4, except for a place where the lead wires 6 are led out from the housing 4 to the external power supply or the like. As a result, inconvenient cases of the lead wires 6 can be prevented. Examples of the inconvenient cases are that the lead wires 6 comes into contact with outside material and are damaged, that the binding band 8 comes into contact with outside material and lead wires 6 protrudes from the outermost surfaces, and that the binding band 8 is damaged and the fixed state of the lead wires 6 is released and the lead wires 6 protrude from the outermost surfaces. Since the blower device 1 can substantially prevent the inconvenient cases concerning the plurality of lead wires 6, the blower device 1 has extremely high reliability.

The plurality of lead wires 6 and the binding band 8 are fixed without protruding from the surface and side peripheral surface of the front surface side flange 4*e*1. Thus, the lead wires 6 and the binding band 8 do not hinder when the blower device 1 is carried or installed on a predetermined location, and the installation space is not limited when the blower device 1 is mounted on a predetermined portion of an equipment.

The binding band 8 is inserted into the lead wire fixing hole 4*g*1 which is independently provided from the mounting through hole 4*f*. Thus, the plurality of lead wires 6 can be fixed no matter whether the through hole 4*f* is used.

In the blower device 1, since the plurality of lead wires 6 fixed by the binding band 8 are disposed in the recess 10 formed between both the flanges 4*e*1 and 4*e*2, the lead wires 6 do not come into contact with outside portion, and the installation space is not limited.

Next, a modification of the above embodiment will be explained.

Figure 4:
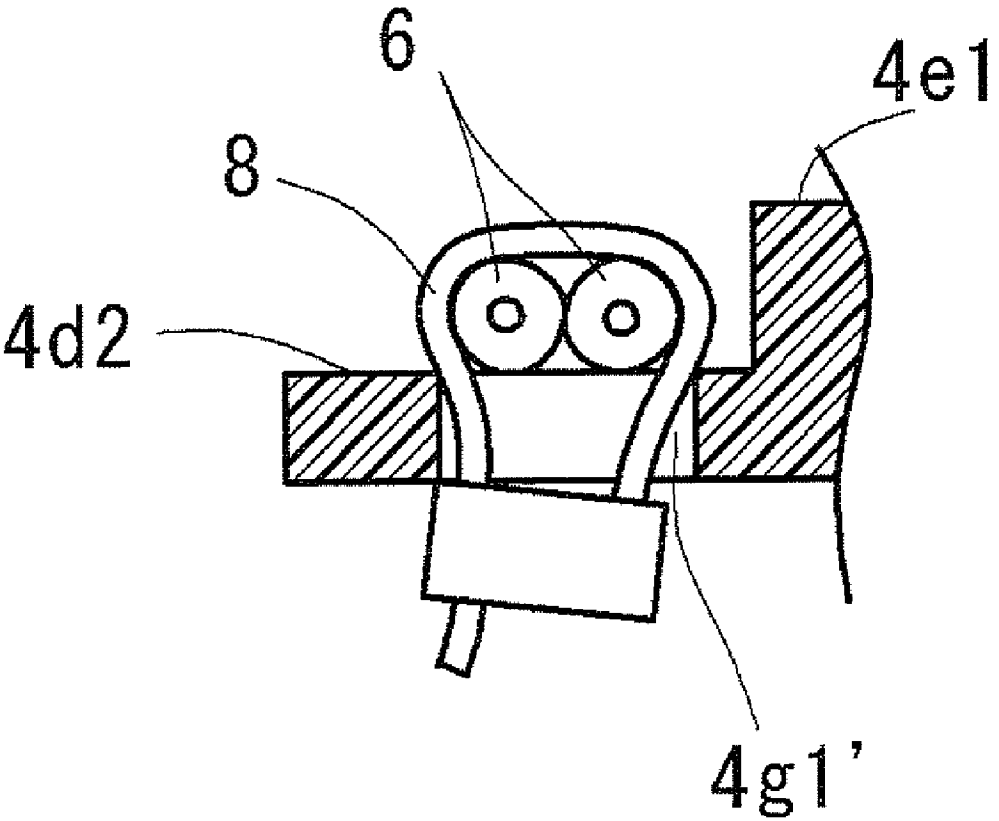
FIG. 4 shows a modification of the first embodiment.

The binding band 8 shown in FIG. 1 is wound around the plurality of lead wires 6 and the front surface side flange 4*e*1 together. Instead of this structure, as shown in FIG. 4, it is also possible that the binding band 8 is wound around the plurality of lead wires 6 on the front surface side of the front surface side flange 4*e*1, and both ends thereof are inserted into a lead wire fixing hole 4*g*1' provided in the second guide groove 4*d*2, and bound on the back surface side of the front surface side flange 4*e*1. The lead wire fixing hole 4*g*1' in this case has an opening area which is two time or more greater than the sectional area of the binding band 8 and smaller than that of the connecting portion. Therefore, the connecting portion of the binding band 8 do not come off from the through hole 4*g*1'.

Figure 5:
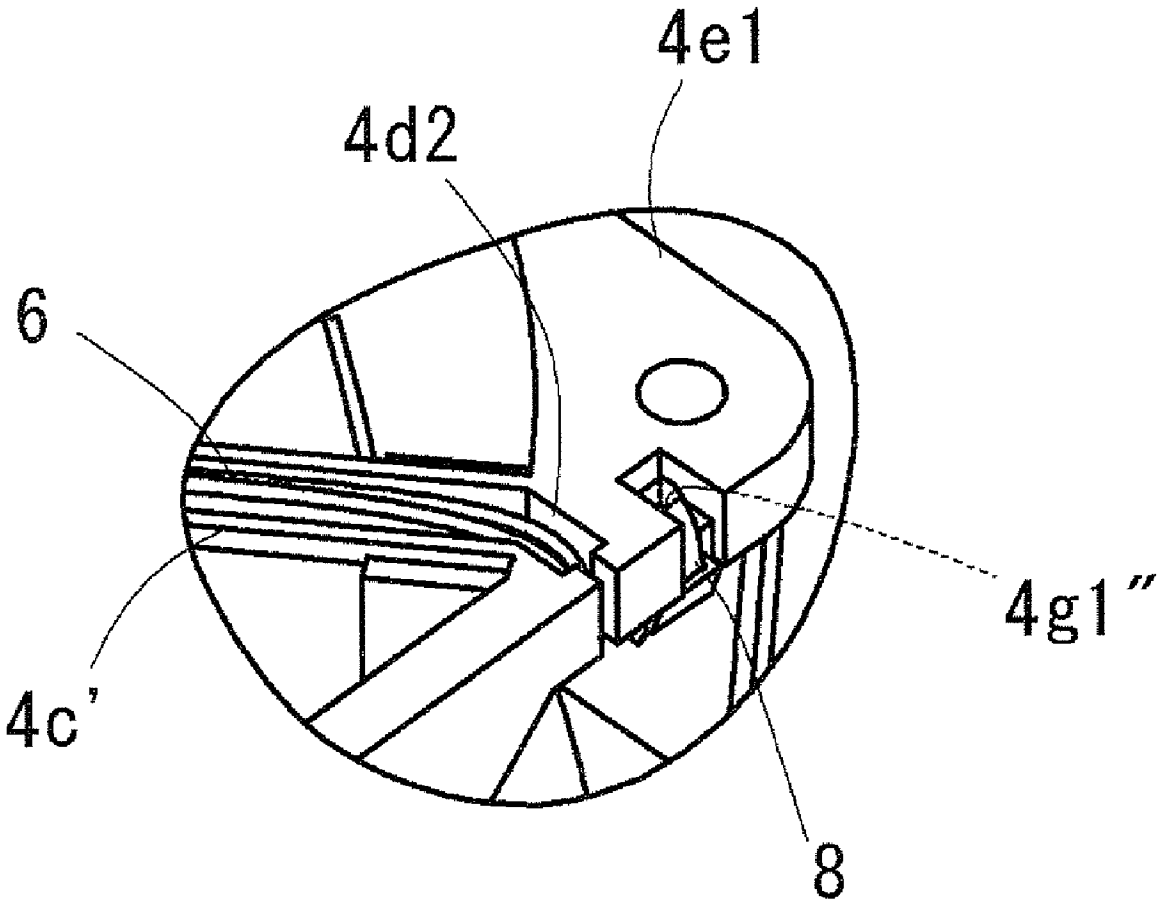
FIG. 5 shows another modification of the first embodiment.

In the embodiment shown in FIG. 1, the plurality of lead wires 6 and the binding band 8 are located in the second guide groove 4*d*2. Instead of this structure, as shown in FIG. 5, a lead wire fixing hole 4*g*1" through which the binding band 8 is inserted may be provided at a different location from the second guide groove 4*d*2. The lead wire fixing hole 4*g*1" is formed at a location dented from the surface and the side peripheral surface of the front surface side flange 4*e*1, and this dented degree is set such that the binding band 8 can be accommodated therein. A portion of a bottom surface of the second guide groove 4*d*2 is inwardly notched. The plurality of lead wires 6 are led out toward the back surface side of the front surface side flange 4*e*1 from the second guide groove 4*d*2 through this notch. The led out lead wires 6 are bound together with the front surface side flange 4*e*1 through the lead wire fixing hole 4*g*1".

Figure 6:
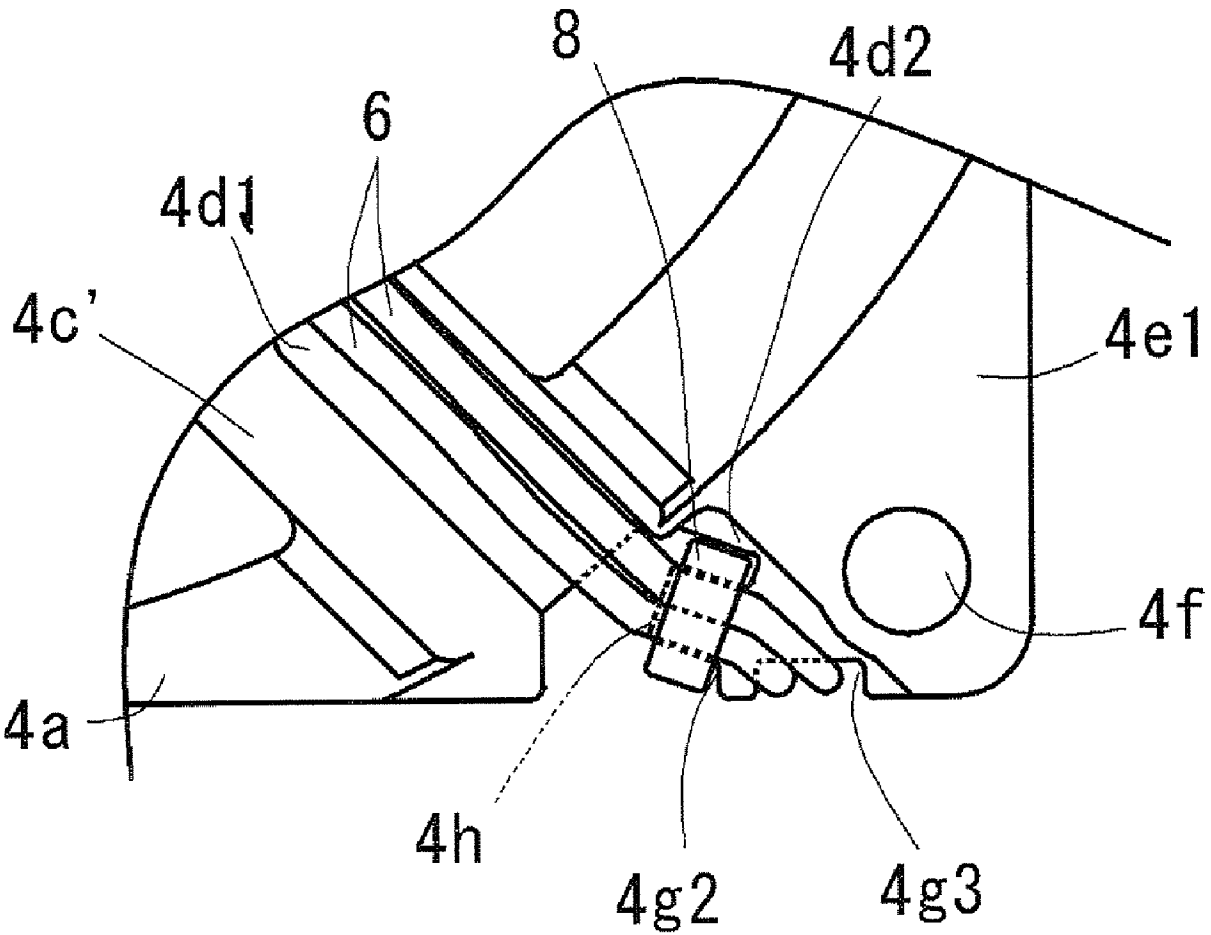
FIG. 6 shows another modification of the first embodiment.

Although the binding band 8 is inserted through the through hole provided at the predetermined portion in the embodiment shown in FIG. 1, it is also possible to employ such a structure that the second guide groove 4*d*2 is provided with a projection 4*h* as shown in FIG. 6, and the binding band 8 is wound around the lead wires 6 and the projection 4*h* like the structure shown in FIG. 1. In other words, the projection 4*h* is provided with a notch formed by cutting out radially outer surface of the front surface side flange 4*e*1. With this structure, the binding band 8 can be inserted through the gap facing a tip end of the projection 4*h*, and this enhances the operability.

Figure 7:
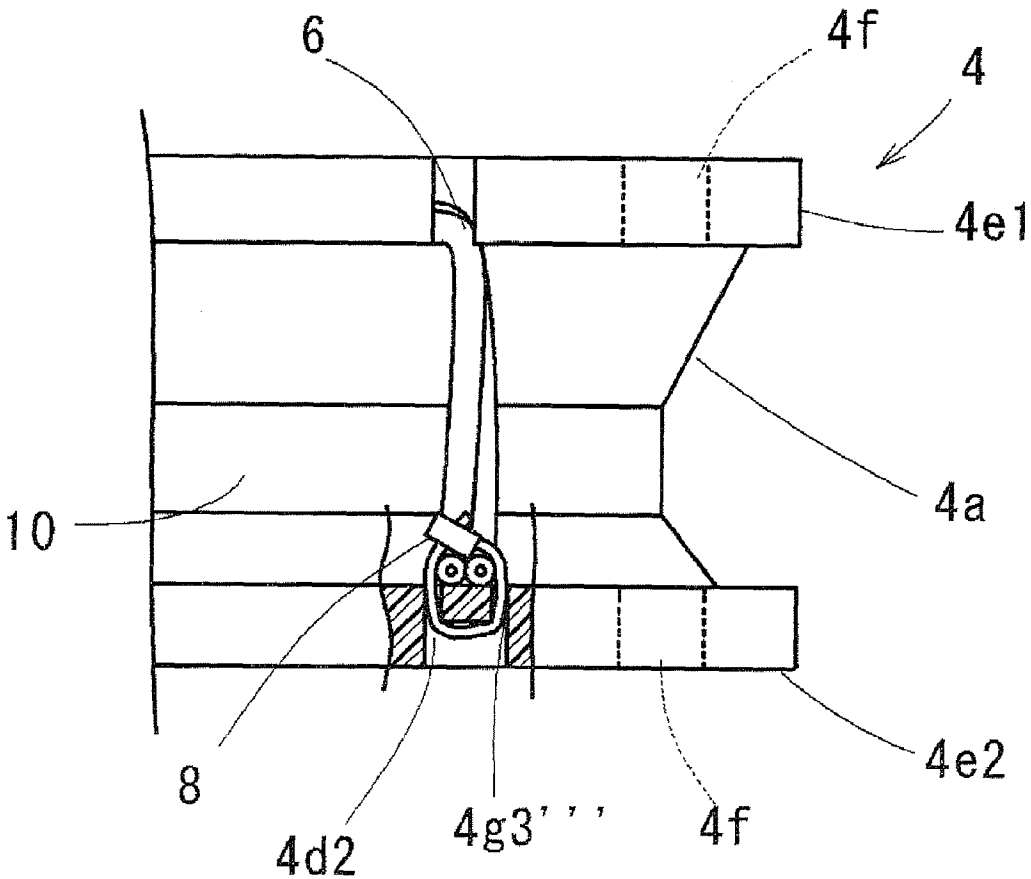
FIG. 7 shows another modification of the first embodiment.

Although the binding band 8 is disposed on the front surface side flange 4*e*1 and fixes the lead wires 6 in the embodiments shown in FIGS. 1, 4, 5 and 6, the vertical relation may be reversed and it is also possible to employ such a structure that the second guide groove 4*d*2 and a lead wire fixing hole 4*g*3''' are provided on the back surface side flange 4e2 and the binding band 8 may be disposed thereon as shown in FIG. 7. In this case the lead wires 6 and the bind member 8 do not protrude from the housing front surface and the housing back surface of the housing 4. In other words, they do not protrude from outermost surfaces of the housing 4, except for a place (the radially outermost peripheral surface of the housing 4) where the lead wires 6 are led out from the housing 4 to the external power supply or the like.

Although the lead wires 6 are led out from the front surface side flange 4e1 toward the back surface side flange 4e2 in the embodiments shown in FIGS. 1, 4, 5 and 6, when it is more convenient for installing the blower device 1 to lead the lead wires 6 from the front surface side flange 4e1, the lead wires 6 may not be retained in the third notch 4g4 and may be led from the back surface side of the front surface side flange 4e1. In this case the lead wires 6 and the bind member 8 do not protrude from the housing front surface and the housing back surface of the housing 4. In other words, they do not protrude from outermost surfaces of the housing 4, except for a place (the radially outermost peripheral surface of the housing 4) where the lead wires 6 are led out from the housing 4 to the external power supply or the like.

In this regard, one of the pair of flanges 4e1 and 4e2 may be omitted or they may be provided on an intermediate portion of an outer frame 4*a*.

The binding band 8 of each of the embodiments may be vertically reversed only if the binding band 8 does not protrude from the surface and the side peripheral surface of the front surface side flange 4e1. In addition, the binding band 8 may have a different shape only if it is a band-like member that can be wound around the lead wires 6 to bind the same. The bind member of this invention may not be the binding band 8 and may be band-like member which binds using another method.

Although the circuit board 3 is provided in the electric motor 2 in the blower device 1 of the embodiments, the circuit board 3 may be provided on a housing outer frame 4*a* of the housing 4 or an external control unit. In this case, the lead wires are led out of the housing from the motor.

Next, a second embodiment of the blower device of the present invention will be explained with reference to FIG. 8 using a centrifugal blower device. The flowing manner of air and air blowing characteristics of the centrifugal blower device are different from those of the axial flow blower device, but the basic structure is the same. In this embodiment, different points as compared with the first embodiment will be explained mainly.

Figure 8:
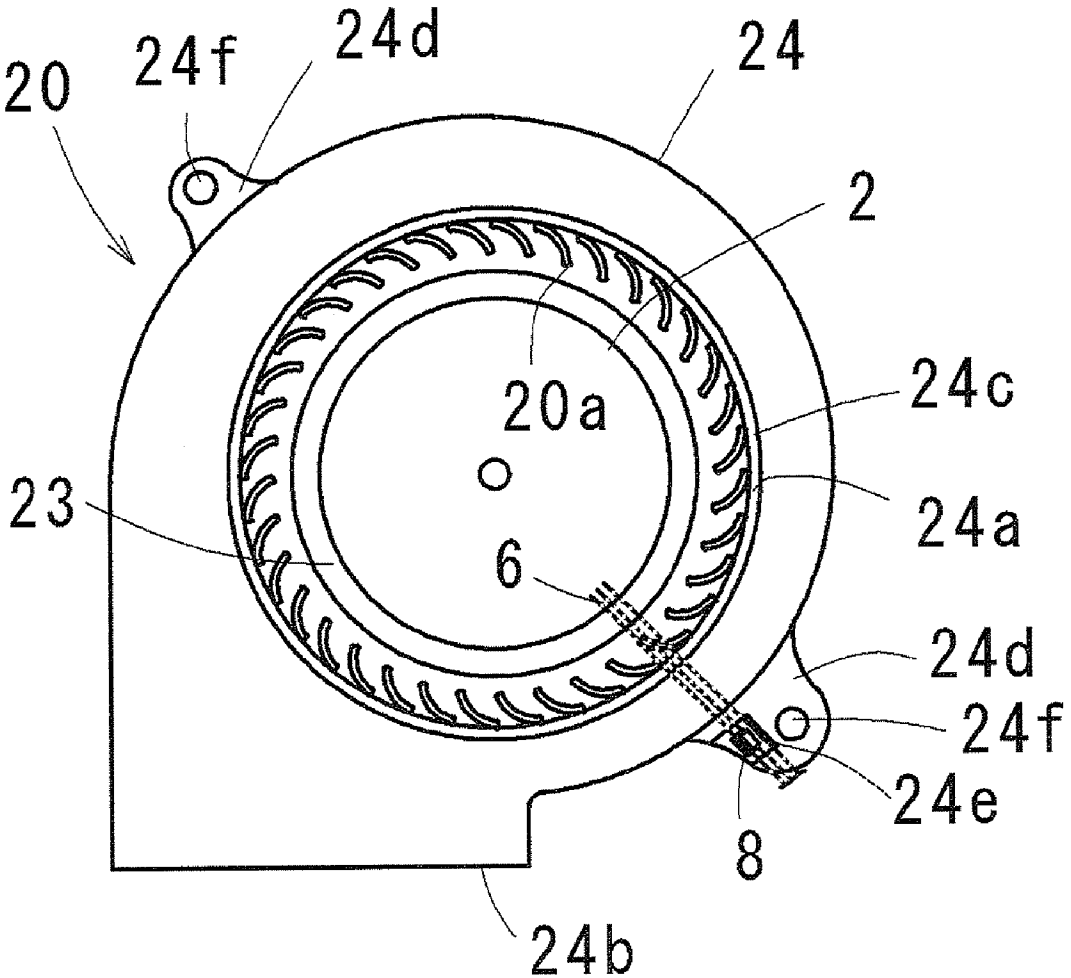
FIG. 8 is a rear view of a blower device according to a second embodiment of the invention.

The blower device 20 shown in FIG. 8 has an impeller 20*a* such a that air flow is sucked along a rotation axis direction of an electric motor 2, and is discharged radially outward of the motor 2. The electric motor 2 has the impeller 20*a*. The electric motor 2 is provided at the back side plate of the housing 24. A suction port 24*a* is provided at the front side plate of the housing 24. A discharge port 24*b* is provided at its peripheral wall of the housing 24. The blower device 24 has a spiral wind tunnel 24*c* between the impeller 20*a* and the peripheral wall. The motor 2 is supported by a motor support portion 23 which is located on the front surface side of the back side plate. If the motor 2 rotates, air flow is generated by the impeller 20*a*, the air is taken into the housing 24 from a suction port 24*a*, and is discharged out from a discharge port 24*b* through a wind tunnel 24*c*. Two flanges 24*d* are provided on a front surface side outer peripheral wall of a housing outer frame of the housing 24. The blower device 20 is mounted on a predetermined portion of an equipment utilizing the two flanges 24*d*. The plurality of lead wires 6 led out from the motor 2 pass through a guide portion (not shown) from a front surface side of the motor support portion 23 and are fixed by the binding band 8 on one of the flanges 24*d*. Any of the various lead wire fixing structures explained in the first embodiment can be used as the flange 24*d*. For example, if the second guide groove in FIG. 1 is applied to the flange 24*d* of the blower device 20 in FIG. 8, the lead wires and the binding band 8 do not protrude from the housing back surface. In other words, they do not protrude from outermost surfaces of the housing 24, except for a place (the radially outermost peripheral surface of the housing 24) where the lead wires 6 are led out from the housing 24 to the external power supply or the like.

In the blower device 20 also, the same effect as that of the blower device 1 of the first embodiment can be obtained.

Although the embodiments of the blower device of the present invention have been explained above, the present invention is not limited to the embodiments, and the invention can variously be modified within a range not departing from the subject matter of the invention.

What is claimed is:

1. A blower device comprising:

an impeller rotatable about a rotation axis to generate an air flow;

a motor rotating the impeller;

a plurality of lead wires connected to the motor at least to supply current from an external electrical current source to the motor;

a bind member binding the lead wires; and a housing accommodating the impeller and the motor, the bind member being separate from the housing, wherein the housing includes: a housing outer frame surrounding the impeller, and having a front surface and a back surface as axially outermost surfaces of the housing and radially outermost surfaces, the axially and radially outermost surfaces constituting outermost surfaces of the blower device;

a motor support portion supporting the motor disposed on an inner central portion of the front surface of the housing outer frame;

a first flange which projects radially outward of the housing outer frame, the first flange having a front surface and its periphery;

a groove portion formed on the front surface; and a guide portion which accommodates the lead wires between the motor support portion and the housing outer frame;

wherein the groove portion accommodates the lead wires and the bind member below the front surface, wherein the bind member is wound around the lead wires to fix the lead wires to the first flange, and wherein the bind member is located radially inside the periphery of the first flange.

2. The blower device according to claim 1, further comprising a circuit board controlling the motor and fixed onto the motor support portion, wherein the lead wires are connected to the circuit board.

3. The blower device according to claim 2, wherein the impeller has a shape allowing generation of an air flow flowing from one axial end toward the other axial end of the impeller when the impeller rotates.

4. The blower device according to claim 3, wherein the bind member includes a band portion made of flexible material and a connecting portion provided on one end of the band portion, the connecting portion having an insertion hole through which the other end of the band portion is inserted, and when the one end of the band portion is inserted through the insertion hole, the ends of the band portion are connected to each other by frictional resistance with respect to an inner wall of the insertion hole.

5. The blower device according to claim 4, wherein the groove portion includes a first groove which is formed by denting the front surface of the first flange, a first through hole connecting to the first groove to axially penetrate the first flange, and a first notch formed on the first groove by axially cutting through a radially outer surface of the first flange, the bind member binds the lead wires together with the first flange by passing between the first notch and the first through hole, and the lead wires are connected to the back surface of the housing outer frame for leading out from the blower device.

6. The blower device according to claim 4, wherein the groove portion further includes a second groove formed by denting a front surface of the first flange, and a second through hole connecting to the second groove to axially penetrate the first flange, the bind member passes around the lead wires at the front side of the first flange, passes through the second groove, and is fastened at a back side of the first flange, and the lead wires are connected to the back surface of the housing outer frame for leading out from the blower device.

7. The blower device according to claim 4, wherein the groove portion further includes a third groove which is formed by denting a front surface of the first flange, a second notch formed in rotational axis direction at a place where is just under and connecting to the third groove, and a projecting portion projecting into the second notch, the bind member binds the lead wires and the projecting portion together to fix the lead wires for the housing not to loosen.

8. The blower device according to claim 5, wherein the groove portion further includes a fifth notch formed at a place next to the first notch, and the lead wires are accommodated in the fifth notch to be connected to the back surface of the housing outer frame for leading out from the blower device.

9. The blower device according to claim 2, wherein the impeller has a shape allowing an air flow to be sucked from one of axial ends of the impeller and discharged radially outwardly.

10. The blower device according to claim 9, wherein the bind member includes a band portion made of flexible material, and a connecting portion which is provided on one end of the band portion and which includes an insertion hole through which the other end of the band portion is inserted, and when the one end of the band portion is inserted through the insertion hole, the ends of the band portions are connected to each other by frictional resistance with respect to an inner wall of the insertion hole.

11. The blower device according to claim 10, wherein the groove portion includes a fourth groove which is formed by denting a front surface of the first flange, a third through hole connecting to the fourth groove to axially penetrate the first flange, and a fourth notch formed on the first groove by cutting through a radially outer surface of the first flange in rotational axis direction, the bind member binds the lead wires together with the first flange by passing between the fourth notch and the third through hole, and the lead wires are connected to the back surface of the housing outer frame for leading out from the blower device.

12. The blower device according to claim 10, wherein the groove portion includes a fifth groove formed by denting a front surface of the first flange, and a fourth through hole connecting to the fifth groove to axially penetrate the first flange, the bind member passes around the lead wires at the front side of the first flange, passes through the fifth groove, and is fastened at a back side of the first flange, and the lead wires are connected to the back surface of the housing outer frame for leading out from the blower device.

13. The blower device according to claim 11, wherein the groove portion includes a sixth groove which is formed by denting a front surface of the first flange, a fifth notch axially formed at a place where is just under and connecting to the sixth groove, and a projecting portion projecting into the fifth notch, and the bind member binds the lead wires and the projecting portion together to fix the lead wires for the housing not to loosen.

14. The blower device according to claim 11, wherein the groove portion includes a sixth notch formed at a place next to the fourth notch, and the lead wires are accommodated in the sixth notch to be connected to the back surface of the housing outer frame for leading out from the blower device to the external electrical current.

* * * * *